United States Patent [19]

Schmid

[11] 4,178,710

[45] Dec. 18, 1979

[54] FLIP LEAF EXHIBITOR HAVING SEPARABLE RING FASTENERS FOR LEAVES

[75] Inventor: Hans F. Schmid, Verona, N.J.

[73] Assignee: Mar-Kal Products Corporation, Montclair, N.J.

[21] Appl. No.: 855,217

[22] Filed: Nov. 28, 1977

[51] Int. Cl.[2] ..... G09F 19/00

[52] U.S. Cl. ..... 40/530; 402/21; 40/591

[58] Field of Search ..... 402/21, 19, 20; 40/591, 40/588, 530; 281/21

[56] References Cited

U.S. PATENT DOCUMENTS

| | | | |
|---|---|---|---|
| 1,046,181 | 12/1912 | Hale | 402/21 X |
| 2,321,559 | 6/1943 | Trussel | 402/21 |
| 2,582,953 | 1/1952 | Bender | 402/21 |
| 3,496,666 | 2/1970 | Morley | 40/591 |
| 3,518,782 | 7/1970 | Long | 40/588 |

FOREIGN PATENT DOCUMENTS

| | | | |
|---|---|---|---|
| 1095917 | 12/1954 | France | 402/21 |

*Primary Examiner*—Louis G. Mancene
*Assistant Examiner*—Wenceslao J. Contreras
*Attorney, Agent, or Firm*—B. P. Fishburne, Jr.

[57] ABSTRACT

A changeable exhibitor or sign includes a base plate for attachment to a primary support and an underlying backbone strip spanning the base plate in one direction and anchored thereto. Flip leaves bearing changeable indicia are hingedly and removably attached to the base plate by arcuate spring binder rings which are received through slots of the flip leaves and which have flat terminals engageable through slots of the base plate and captively held releasably between the base plate and backbone strip. The necessity for riveting is avoided. The construction is economical and reliable.

2 Claims, 4 Drawing Figures

FIG.1
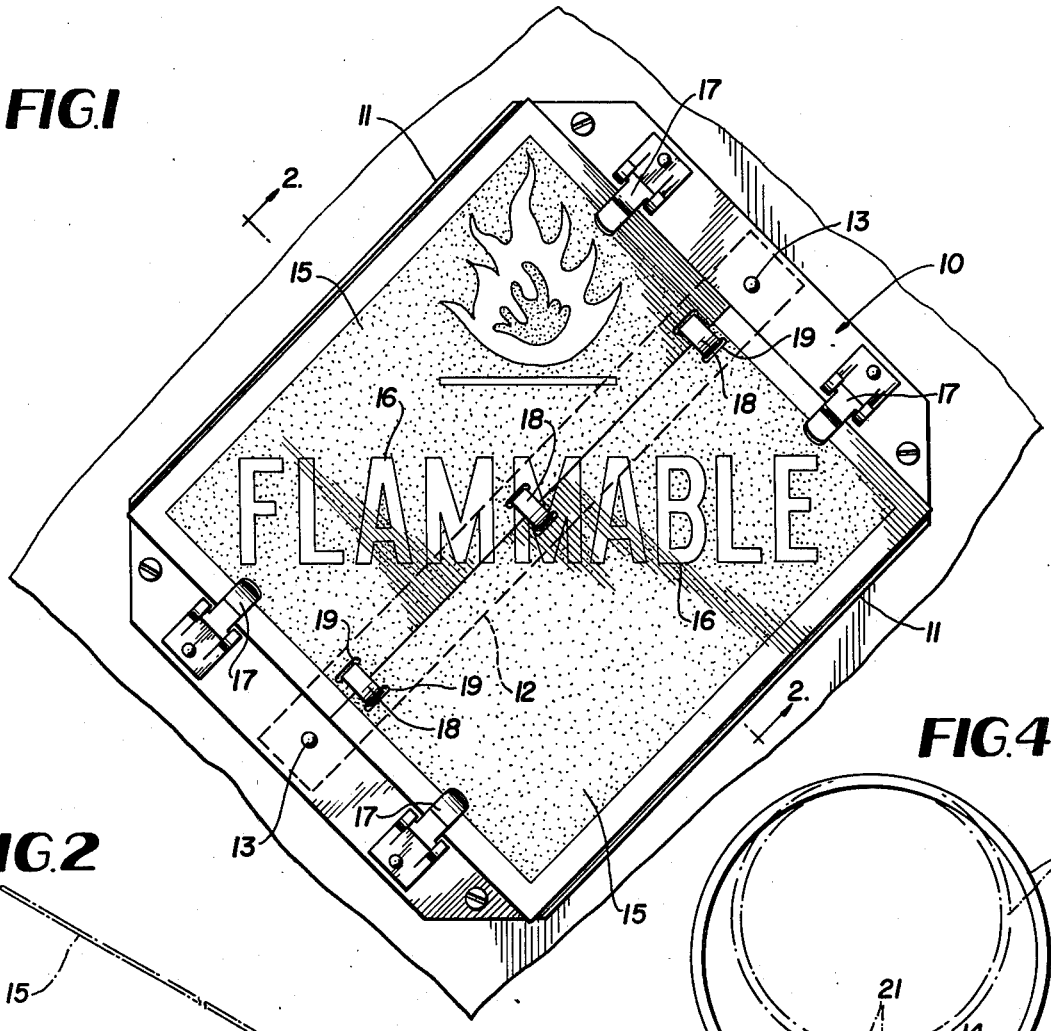
FIG.4
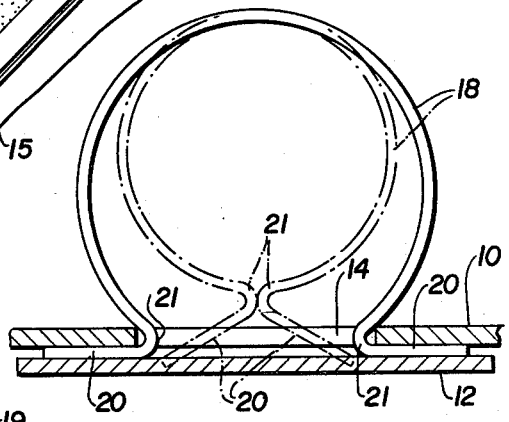
FIG.2
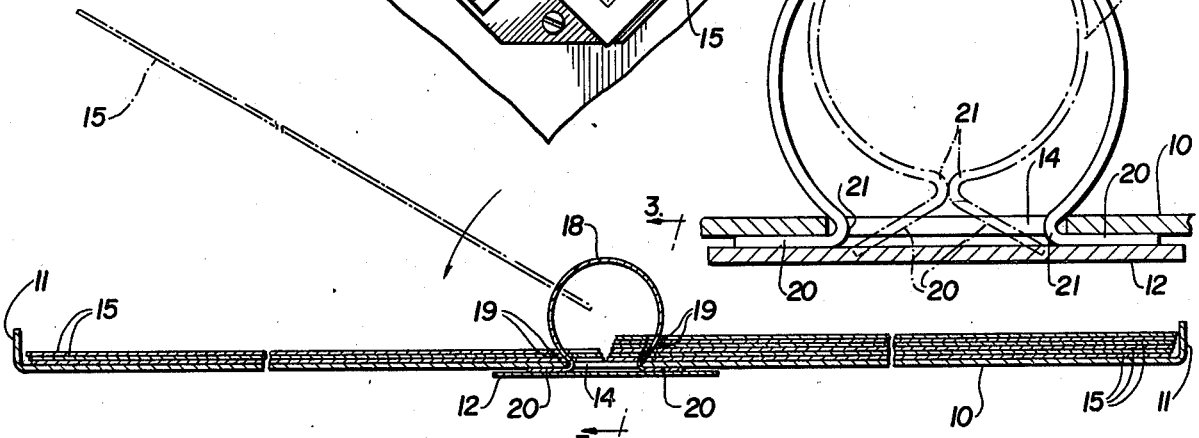
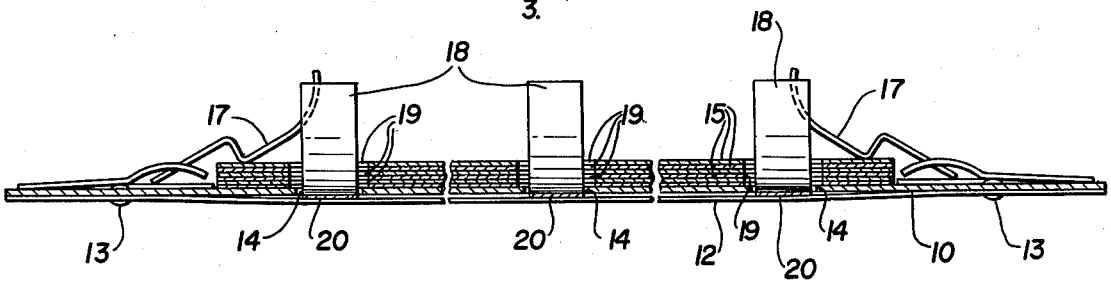
FIG.3

FLIP LEAF EXHIBITOR HAVING SEPARABLE RING FASTENERS FOR LEAVES

BACKGROUND OF THE INVENTION

Government regulations covering certain truck signs pertaining to hazardous materials and other changeable exhibitor applications make it highly desirable to employ signs having hinged or flip leaves to enable the indicia displayed to be changed quickly. Flip leaf signs are known in the prior art but have suffered from some drawbacks including bulkiness, excessive manufacturing costs and difficulty in removing the indicia leaves conveniently from the sign base structure. Customarily, the leaf anchor or binder elements are in the form of rings having at least one end permanently attached to the base member of the sign by riveting. Examples of the patented prior art are contained in the following U.S. Pat. Nos.:

1,082,155
1,589,005
1,727,336
1,797,413
2,208,213
2,378,151
2,501,044
3,136,082
3,180,488
3,191,319
3,481,060
3,496,666

It is the objective of this invention, therefore, to provide a more simplified, less expensive and more efficient flip leaf sign which is convenient to use and which is particularly suitable as a hazardous materials changeable sign for trucks, while at the same time being suitable for many other uses.

SUMMARY OF THE INVENTION

An essentially flat sign base or mounting plate has spaced slots formed therein centrally. A backbone strip closely underlies these slots and spans the base plate in one direction along the common axis of the slots and is attached near its opposite ends to the base plate. Spring material flip leap attaching and release rings engage loosely through apertures of the leaves and at their opposite ends carry flat terminals or feet which project outwardly in opposite directions relative to the rings. the ring terminals or feet are insertable through and withdrawable from the slots of the base plate when the spring rings are contracted. When the rings are allowed to expand, their end terminals engage lockingly between the rear side of the base plate and the backbone strip. The construction is neat and compact, requires no tools to operate, avoids the use of rivets or other fasteners, is highly convenient to use and economical.

BRIEF DESCRIPTION OF THE DRAWINGS

FIG. 1 is a plan view of a flip leaf exhibitor or sign as the same would appear mounted on the side of a truck or the like.

FIG. 2 is an enlarged vertical section taken on line 2—2 of FIG. 1.

FIG. 3 is a fragmentary vertical section taken on line 3—3 of FIG. 2.

FIG. 4 is an enlarged fragmentary vertical section similar to FIG. 2 depicting the operation of the releasable spring binder rings.

DETAILED DESCRIPTION

Referring to the drawings in detail, wherein like numerals designate like parts throughout, the numeral 10 designates a flat base plate for a sign or exhibitor embodying the invention and being formed of aluminum or the like. The base plate 10 may have a pair of parallel upstanding flanges 11 along opposite sides thereof, but these flanges are not essential in the invention.

A backbone or reinforcing strip 12 spans the underside of the base plate 10 from end-to-end thereof at the transverse center of the base plate. The opposite ends of the backbone strip 12 are attached by rivets 13 to end portions of the base plate 10 permanently as shown. The base plate 10 is provided adjacent to the backbone strip 12 with a plurality of spaced rectangular slots 14 and which slots 14 are centered relative to the strip 12 so as to be entirely covered and concealed thereby on the underside of the structure where the strip 12 is located.

The sign further comprises any practical number of rectangular flip leaves 15 each bearing on the opposite faces thereof components of indicia 16 which make up words, symbols or other intelligence which it is desired to display in a variable or changeable manner during the use of the flip leaf sign. For example, when the sign is used on trucks transporting hazardous materials, the flip leaves can be adjusted to form such words as "flammable", "Poison", "Oxidizer" or the like. The indicia can be quickly changed to meet needs by simply flipping the leaves 15 and anchoring them in the selected use position by means of conventional over-center spring clips 17.

A major feature of the invention comprises an improved and simplified means for releasably securing the flip leaves 15 to the sign base plate 10 whereby the leaves can be easily flipped back and forth or removed bodily from the sign for replacement by other leaves when required. This means requires no tools to operate and involves no rivets or fasteners, such as screws. The improved means can be operated entirely with the fingers and is safe, convenient, economical, very compact, as well as neat in appearance.

This important means comprises plural spring metal or other spring material binder rings 18 corresponding in number and placement to the slots 14 and being of a width, FIG. 3, to enter these slots with some small clearance provided. The spring rings 18 are also received through slots 19 formed in the flip leaves 15 near their interior longitudinal edges. The slots 19 receive the rings 18 loosely so that the leaves 15 can easily be flipped over, as required.

The spring binder rings 18 are provided at their opposite ends with oppositely directed flat coplanar terminals or feet 20 which are integrally connected to the bodies of the rings 18 by abruptly curved elbows 21 or bends, FIG. 4. When the spring rings 18 are contracted by the fingers until the elbows 21 are in abutment as shown in broken lines in FIG. 4, the feet or terminals 20 can be inserted through the slots 14 and the rings can then be released and allowed to expand outwardly to their normal relaxed positions shown in full lines in the drawings. In so doing, the flat feet 20 will slide between the bottom of the base plate 20 and the underlying backbone strip 12 until the elbows 21 lock against the opposite edges of the slots 14, FIG. 4. When the rings 18 are thus positioned, there is no way for the leaves 15 to separate from the rings or from the sign structure as they are flipped back and forth during use.

To quickly separate the rings 18 from the base plate 10 without the use of tools in order to allow the quick installation of a different group of flip leaves bearing different indicia, it is merely necessary to squeeze the rings 18 with the fingers until they assume the broken line position of FIG. 4. At this time, the rings can be withdrawn through the slots 14, as their feet 20 are no longer between the base plate 10 and the covering and protecting backbone strip 12. Once the rings are withdrawn, the flip leaves 15 can easily be removed from the rings and replaced by other leaves and the rings are then contracted and allowed to expand into the active locking positions shown in full lines in the drawings.

Simplicity, convenience and economy of the construction compared to the prior art should be readily apparent to those skilled in the art without further description.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A changeable exhibitor comprising a substantially flat base plate having plural spaced rectangular slots formed therethrough centrally of the base plate in a row across the base plate, a comparatively narrow elongated flat backbone strip underlying the base plate adjacent to said row of rectangular slots and covering said slots, means fixedly securing opposite end portions only of the backbone strip to the base plate with the main body portion of the backbone strip adjacent to said rectangular slots unattached to the base plate, plural independently operable separately formed retainer rings formed of flat spring strip stock and corresponding in number to said rectangular slots, said retainer rings being identical and each including a major circumference body portion having opposite end abrupt elbows and a pair of oppositely extending flat terminals projecting outwardly of the elbows in a common plane generally tangentially to the body portion, said terminals of each retainer ring being resiliently biased toward separated positions, and said retainer rings being manually contractable to allow said terminals to enter and pass through said rectangular slots of the base plate and to then pass between the base plate and the unattached body portion of said backbone strip with said elbows engaging opposite ends of said rectangular slots when the retainer rings are allowed to expand, and plural flip leaves bearing indicia components and having openings near corresponding edges thereof receiving the body portions of the retainer rings.

2. A changeable exhibitor as defined in claim 1, and the axial widths of the retainer rings being only slightly greater than the corresponding widths of said rectangular slots of the base plate along the longitudinal axis of said backbone strip.

* * * * *